US007219962B2

(12) United States Patent
Stone

(10) Patent No.: US 7,219,962 B2
(45) Date of Patent: May 22, 2007

(54) DESIGN AND ASSEMBLY TECHNIQUE FOR READY TO ASSEMBLE FURNITURE

(76) Inventor: Kathleen A. Stone, 271 Winthrop Rd., Columbus, OH (US) 43214

( * ) Notice: Subject to any disclaimer, the term of this patent is extended or adjusted under 35 U.S.C. 154(b) by 0 days.

(21) Appl. No.: 11/107,939

(22) Filed: Apr. 18, 2005

(65) Prior Publication Data

US 2005/0242631 A1 Nov. 3, 2005

Related U.S. Application Data

(60) Provisional application No. 60/568,113, filed on May 3, 2004.

(51) Int. Cl.
*A47C 7/00* (2006.01)

(52) U.S. Cl. ..... 297/440.13; 297/440.14; 297/440.15; 297/440.23; 297/440.1

(58) Field of Classification Search ..... 297/440.1, 297/440.13, 440.14, 440.15, 440.23
See application file for complete search history.

(56) References Cited

U.S. PATENT DOCUMENTS

| | | | | | |
|---|---|---|---|---|---|
| 2,279,864 | A | | 4/1942 | Eide | |
| 2,334,912 | A | | 11/1943 | Eide | |
| 2,720,253 | A | * | 10/1955 | Turner et al. | 297/440.13 |
| 4,140,065 | A | | 2/1979 | Chacon | |
| 4,279,455 | A | | 7/1981 | Santo | |
| 4,348,052 | A | | 9/1982 | Roland | |
| 4,497,524 | A | | 2/1985 | Levings, Jr. | |
| 4,574,917 | A | | 3/1986 | Stoddard | |
| 4,593,950 | A | * | 6/1986 | Infanti | 297/3 |
| 4,712,837 | A | * | 12/1987 | Swilley | 297/440.13 |
| 4,832,421 | A | | 5/1989 | Shoffner | |
| 4,867,327 | A | | 9/1989 | Roland | |
| 4,919,485 | A | * | 4/1990 | Guichon | 297/440.23 |
| 5,000,514 | A | * | 3/1991 | Hanson | 297/440.13 |
| 5,011,228 | A | | 4/1991 | Marcantel | |
| 5,082,629 | A | | 1/1992 | Burgess, Jr. et al. | |
| 5,263,766 | A | | 11/1993 | McCullough | |
| 5,275,467 | A | * | 1/1994 | Kawecki | 297/440.13 |
| 5,765,922 | A | | 6/1998 | Hsia | |
| 5,803,548 | A | | 9/1998 | Battle | |
| 5,921,631 | A | | 7/1999 | Bush | |
| 5,992,938 | A | | 11/1999 | Jones | |
| 5,996,145 | A | | 12/1999 | Taylor | |
| 6,036,270 | A | | 3/2000 | Bufalina | |
| 6,267,446 | B1 | * | 7/2001 | Wieland et al. | 297/440.13 |
| 6,279,997 | B1 | * | 8/2001 | Moore et al. | 297/440.1 |
| 6,582,022 | B2 | * | 6/2003 | LaBlance | 297/440.14 |
| 6,619,749 | B2 | | 9/2003 | Willy | |
| 6,675,979 | B2 | * | 1/2004 | Taylor | 211/186 |
| 6,769,369 | B1 | | 8/2004 | Brandenberg | |
| 6,955,401 | B1 | * | 10/2005 | Shoulberg | 297/440.13 |
| D514,340 | S | * | 2/2006 | Frey | D6/368 |

OTHER PUBLICATIONS

Kathleen A. Stone, Photographs of Applicant's prior art ready to assemble furniture. Publicly shown and offered for sale May 16, 2001.

* cited by examiner

*Primary Examiner*—David R. Dunn
*Assistant Examiner*—Sarah B. McPartlin

(57) ABSTRACT

A furniture system comprising mutually supporting components including a pair of identically configured side panels, a load supporting panels and a back panel. The back panel is engages the side panels and the load supporting panel to provide rigidity to the furniture item. A locking member is provided that holds the furniture item rigidly in an assembled condition.

2 Claims, 6 Drawing Sheets

DESIGN AND ASSEMBLY TECHNIQUE FOR READY TO ASSEMBLE FURNITURE

CLAIM OF BENEFITS

This application claims the benefits of Provisional Application No. 60/568,113 filed May 3, 2004.

BACKGROUND OF THE INVENTION

The present invention relates generally to articles of furniture. More specifically, the invention concerns furniture that is "ready-to-assemble" or knockdown.

Knock-down or ready-to-assemble ("RTA") furniture is substitute for the traditional, one-piece, articles of furniture. RTA furniture is often significantly less expensive than its already assembled counterpart. Less expensive, durable and serviceable makes it an attractive alternative to already assembled furniture. Moreover, RTA furniture provides a wide range of configurations.

RTA furniture is not a new concept. RTA furniture relies upon interlocking tabs and notches and maintaining a tight fit between spliced tabs and notches to keep the article of furniture solid.

DESCRIPTION OF THE DRAWINGS

These needs are met by a novel RTA furniture array that is reflected in the following written description together with the accompanying figures.

DESCRIPTION OF THE PREFERRED EMBODIMENTS

Figure 1:
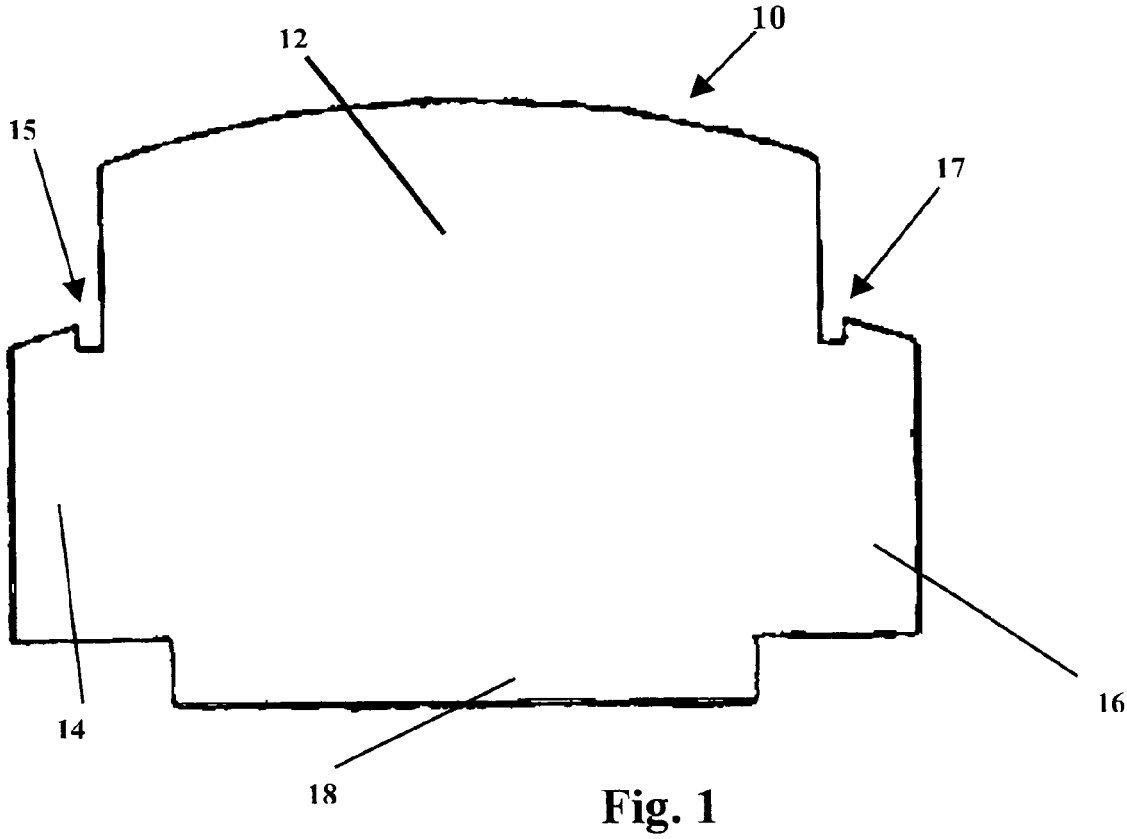
FIG. 1 is a top plan view of one structural element of a piece of RTA furniture in accordance with one embodiment of the present invention.

To facilitate further understanding of the invention, reference will now be made to the embodiments illustrated in the drawing and described in the following written specification.

The article of RTA furniture described as providing the environment for construction using the principles of the present invention is a chair.

Referring to FIG. 1, one structural element comprising a flat panel seat 10 includes a primary load supporting area 12, oppositely extending support tabs 14 and 16, and a rearwardly extending tab 18. The oppositely extending tabs 14 and 16 define with the load supporting area 12 notches 15 and 17.

Figure 2:
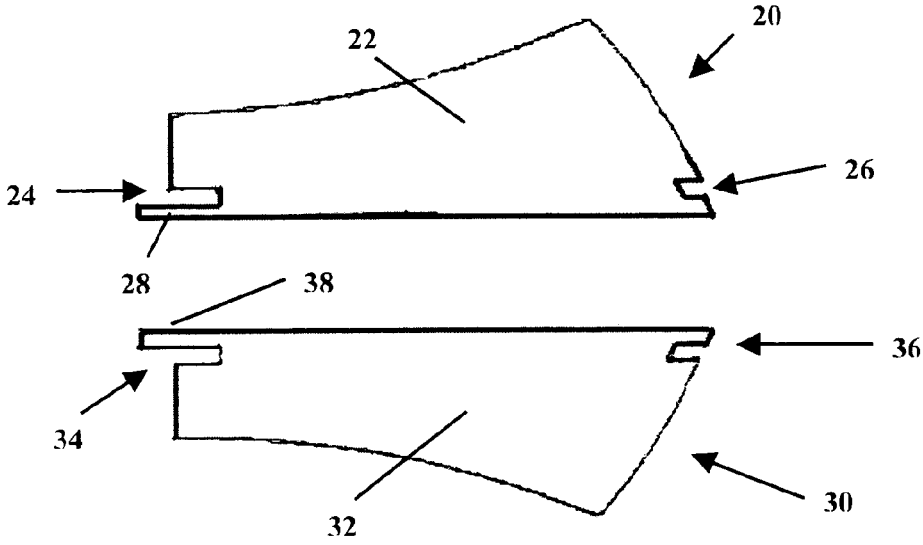
FIG. 2 is a top plan view of another structural element of a piece of the article of RTA furniture to be constructed in accordance with the present invention.

The structural elements shown in FIG. 2 are flat panel arm supports 20 and 30. The arm supports 20 and 30 are for use on the left and right sides of the article of RTA furniture to be constructed in accordance with the present invention.

Figure 3:
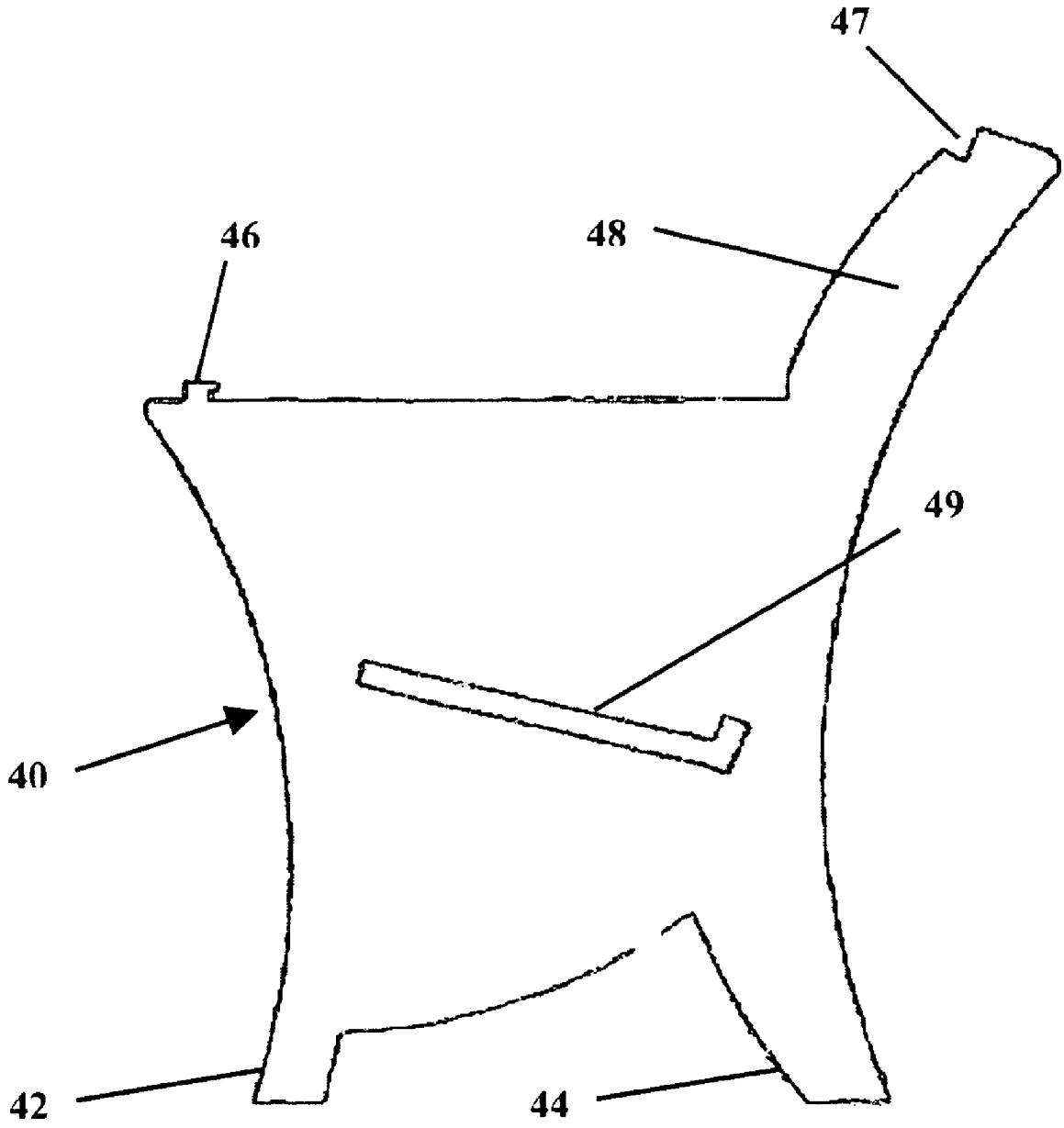
FIG. 3 is plan view of still another structural element of the article of RTA furniture to be constructed in accordance with the present invention.
Figure 4:
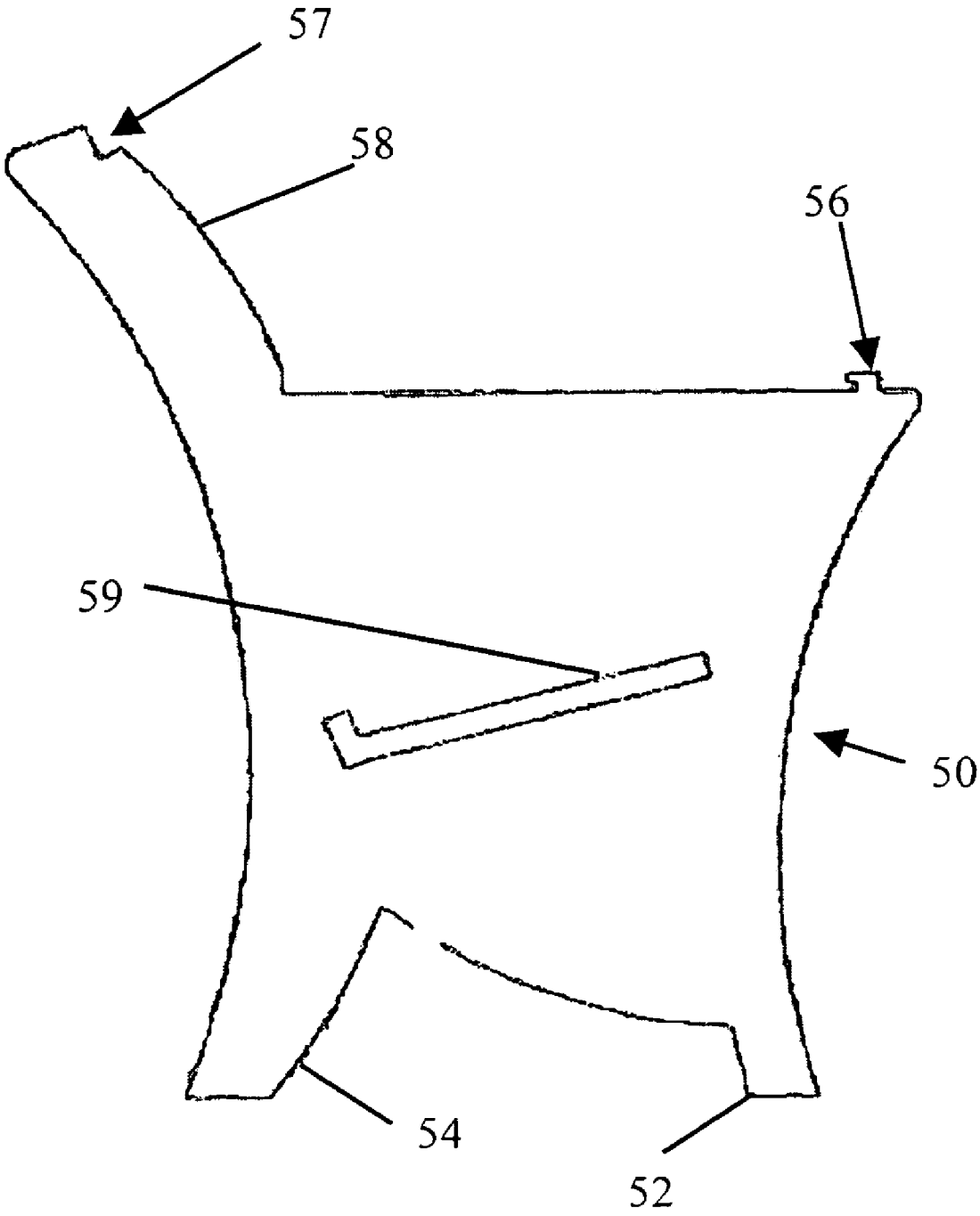
FIG. 4 is a plan view of another structural element, which is a mirror image of element shown in FIG. 4, of the article of RTA furniture to be constructed in accordance with the present invention.
Figure 5:
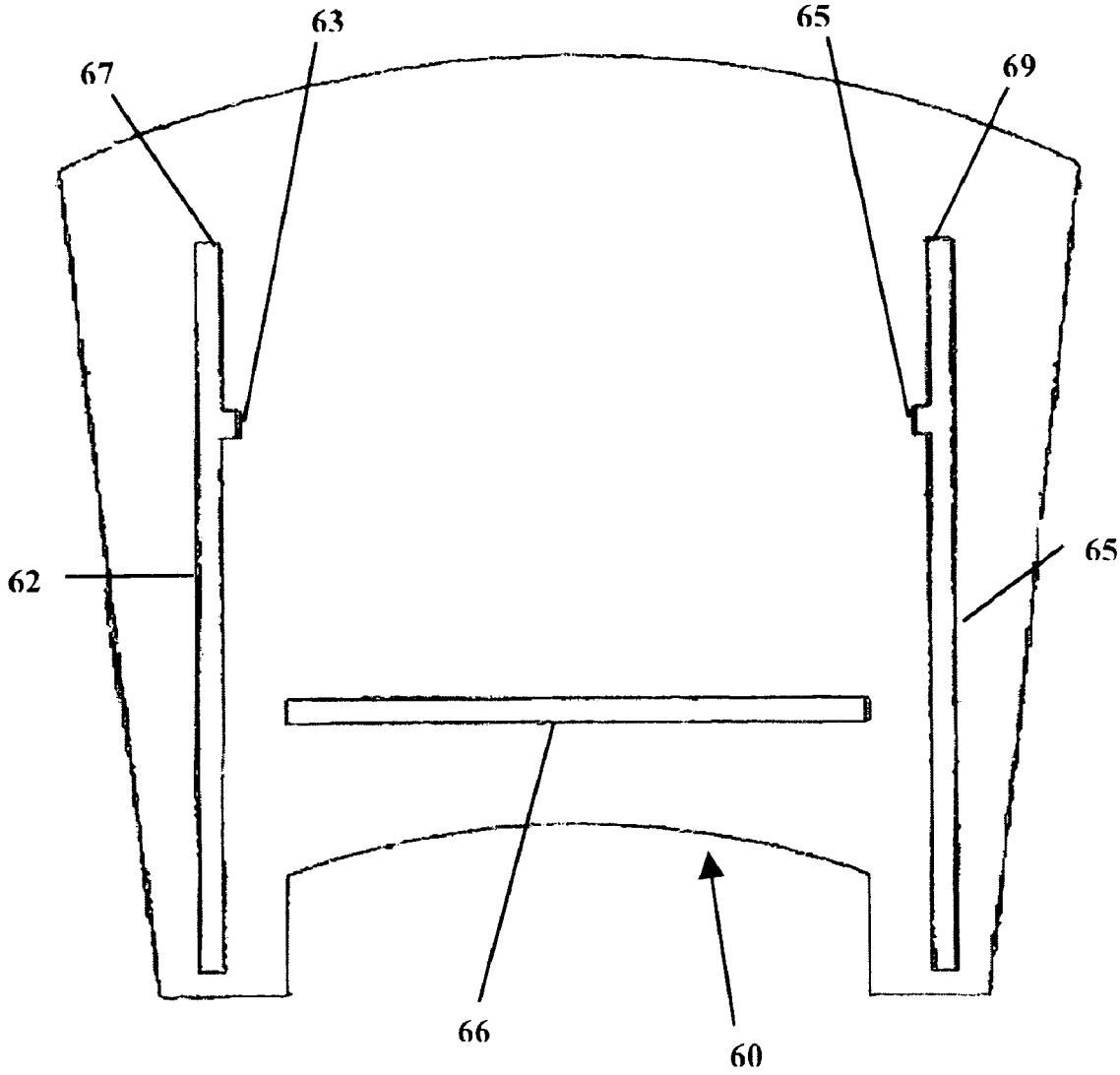
FIG. 5 is a front view of a further structural element of the article of furniture to be constructed in accordance with the present invention.

The arm supports 20 and 30 include support areas 22 and 32. Also, the support areas 22 and 32 include notches 24 and 34 and 26 and 36 that are provided to support the arm supports on the structural elements of FIGS. 3 and 4 as will be described hereinafter. The arm supports 20 and 30 also include tabs 28 and 38 which are used to help secure and stabilize the arm supports when the RTA furniture is assembled in accordance with this invention. As with the notches 24 and 34, the function of the tabs 28 and 38 will be described hereinafter. The structural elements shown in FIGS. 4 and 5 are flat panel sides 40 and 50 that provide the support for the primary load supporting member 10 of FIG. 1 and the chair assembled in accordance with the present invention. The sides 40 and 50 include front and rear legs and feet 42, 44 and 52, 54.

Figure 7:
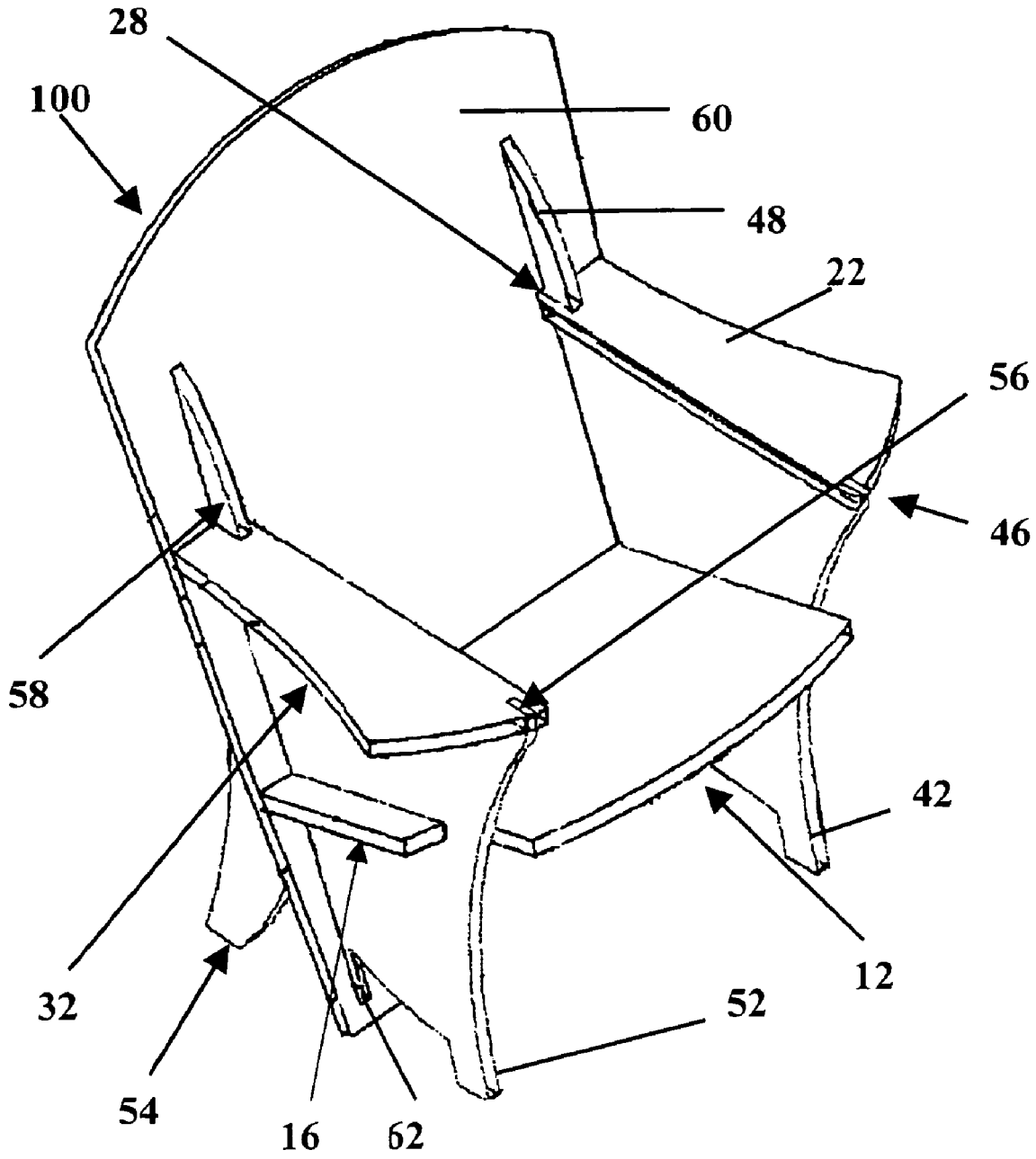
FIG. 7 is a front perspective view of the article of RTA furniture constructed in accordance with the invention.
Figure 8:
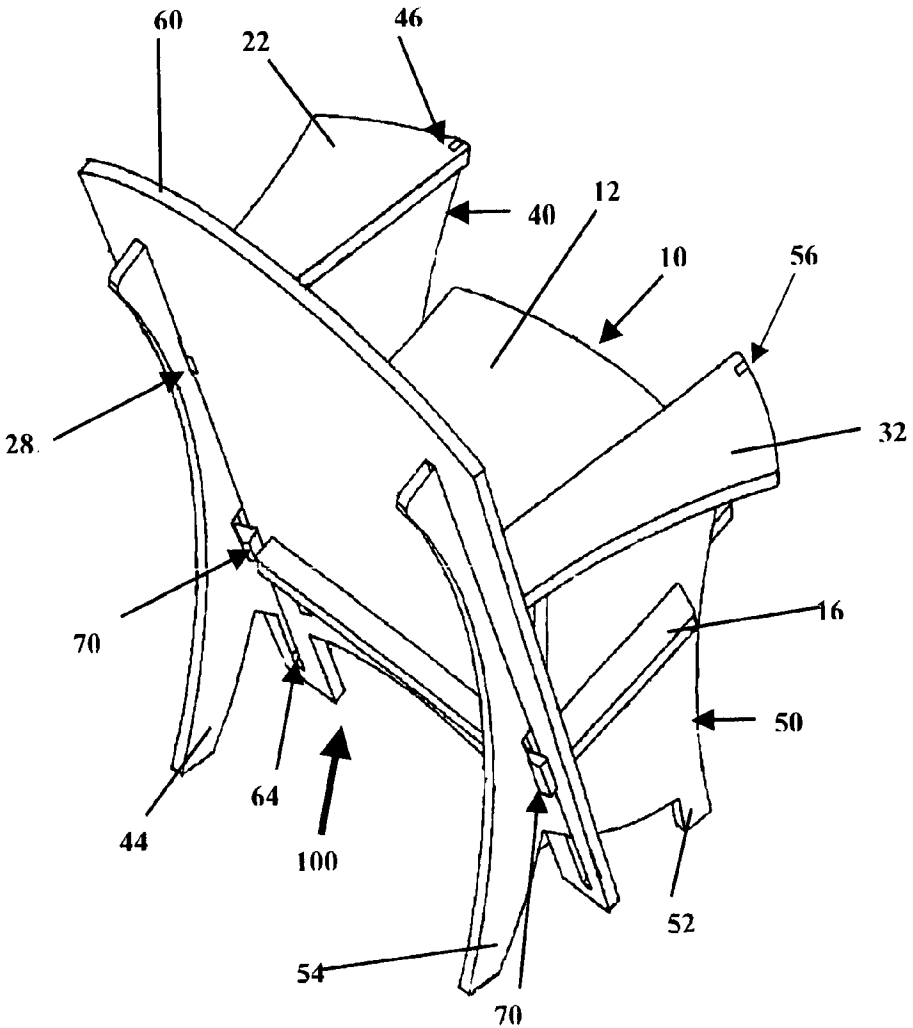
FIG. 8 is a rear perspective view of the article of RTA furniture constructed in accordance with the invention.

The sides also include a tab 46, 56 for cooperating with the notches 24 and 34 supporting and stabilizing the arm supports 20 and 30. A further tab 48 and 58 is provided on the sides 40 and 50 that will be used to support a back panel of the chair when the RTA furniture is assembled as shown in FIGS. 7 and 8. Also, the sides 40 and 50 include mirror image L-shaped notches 49 and 59. The notches 49 and 59 cooperate with the tabs 14 and 16 and notches 15 and 17 on the primary load support 10 to secure and stabilize the support 10 and sides 40 and 50 when the RTA furniture is assembled in accordance with the present invention.

FIG. 5 shows a flat panel back support member 60 for the RTA furniture of the present invention. The back support member 60 includes vertical notches 62 and 64 and a horizontal notch 66. The horizontal notch 66 accepts the rearwardly extending tab 18 of the primary load support 10, and the horizontal notches 62 and 64 slide over the sides 40 and 50 to provide a back support member 60 for the RTA furniture to be assembled in accordance with the present invention.

The vertical notches 62 and 64 also include small, horizontally extending notches 63 and 65. The notches 63 and 65 accept the tabs 28 and 38 of the arm supports 20 and 30 shown in FIG. 2. The cooperation of the notches 63 and 65 with the tabs 28 and 38 help to secure and stabilize the arm supports 20 and 30 when the RTA furniture is assembled in accordance with the present invention.

Figure 6:
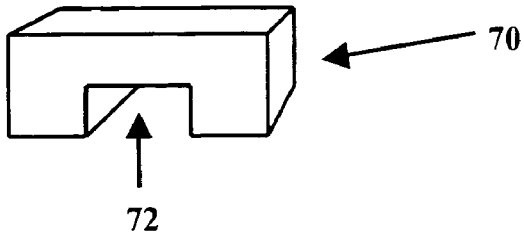
FIG. 6 is a perspective view of a key which is used to retain the elements of FIGS. 1 through 5 of the article of RTA furniture constructed in accordance with the invention.

FIG. 6 shows a C-shaped locking key 70 defining a notch 72. The function of the key 70 will be described below in reference to FIG. 8.

FIG. 7 shows a front perspective of the article of RTA furniture assembled in accordance with the present invention.

FIG. 8 shows a rear perspective view of the article of RTA furniture assembled in accordance with the present invention. FIG. 8 shows the C-shaped key 70 in place in the notches 49 and 59. The notch 72 in the key 70 fits snuggly over the flat panel side 40 and 50. The key 70 serves to hold all of the structural elements, i.e., the support 10, the sides 40 and 50, the back 60 together.

The drawings represent one possible embodiment of the ready-to-assemble article of furniture of the present invention. In this embodiment, the furniture is a chair 100 that is formed from the several components shown in the drawing.

Specifically, the chair 100 is formed by a pair of side panels 40 and 50, a back panel 60, a base panel 10 and a pair of locking members 70.

Each of the components is preferably formed of wood, either as solid wood elements or as pressed-wood or wood composite elements. The components are designed to be cut, preferably by means of a laser cutter, from standard sized sheet material. Alternatively, the components can be formed of new or recycled composites, elastomers, plastic or other suitable materials. In order to maintain the ready-to-assemble attributes of the chair 100, the material of the components should be sufficiently rigid and strong, yet lightweight to facilitate the construction of the type of furniture contemplated.

As shown in more detail in FIGS. 7 and 8, the chair components include pre-cut or pre-formed features for ornamental and functional attributes of the chair 100. For instance, as is shown in FIGS. 7 and 8, the side and back panels 40, 50 and 60 exhibit a generally trapezoidal configuration with decorative cut-outs, and each defines a pair of legs 42, 44 and 52, 54 for supporting the article of furniture.

The side panels 40 and 50 in this embodiment are identically configured, each including a closed L-shaped notch 49 and 59 and a back tab 49 and 58 formed near the top of each panel. The notch 49, 59 is contained within the interior of the panel 40, 50 and can be oriented at an angle with respect to horizontal, as depicted in FIGS. 3 and 4. Alternatively, the notch 49, 59 can run generally parallel with the lower edge of the legs 42, 44 and 52, 54, so that the support 10 will sit horizontal in the assembled article of furniture. In the illustrated embodiment, the notch 49, 59 is angled such that the support member 10 has a small angle that makes sitting more comfortable.

Likewise, each side panel 40, 50 can be configured so that the back panel 60, when assembled onto the side panels 40, 50 will be non-vertical to provide a comfortable seating position.

The back panel 60 defines a pair of side notches 62 and 64 at opposite sides of the panel. The notches 62 and 64 permit the side panels 40 and 50 to be inserted therethrough. The back panel 60 is supported by the tabs 48, 58 on the side panels 40 and 50 and by the side panels 40, 50.

The back panel 60 also defines a pair of notches 63, 65 perpendicular to the notches 62, 64 that interlock with the ends of the tabs 28, 38 in the arm support panels 20, 30.

All notches in the various components are sized for an appropriate interference fit to help provide tightness, rigidity and stability to the final RTA furniture assembly.

The final component of the article of furniture is the locking member 70. The key 70 is sized to slide into the short leg of the L-shaped notch 49, 59.

This assembly of the RTA chair 100 is not shown in any figure of the drawing, but can be described as follows:

a) side panels 40 and 50 are inserted into the notches 62 and 64 in the back panel 60 until the back panel 60 engages the upwardly extending arms on the side panels 40 and 50, b) the side panels 40 and 50 are spread apart somewhat to allow the insertion of the primary support element 10 with the rearwardly extending tab 18 inserted into the horizontal notch 66 in the back panel 60, c) the side panels 40 and 50 are moved to a position so that the notches 49 and 59 engage the laterally extending tabs 14 and 16 on the primary support element 10, d) the arm support elements 20 and 30 are installed on the side panels 40 and 50 so that rearwardly extending tabs 28, 38 fit into the horizontal notches 63, 65 and the upwardly extending tabs 46, 56 of the side panels 40, 50 engage notches 26, 36 thereby securing the arm support elements 20 and 30.

e) a C-shaped keys 70 is inserted in the L-shaped notch 49 and 59 and moved downwardly over the side panels 40, 50 to secure the RTA furniture in its fully assembled condition.

The construction of the components of the chair 100 using the above described sequence and technique are firmly inter-engaged to establish a rigid and solid piece of furniture. The locking function is achieved by interlocking notches and by an interference provided by the key 70.

Hence although the invention has been described in respect of one type of RTA furniture, i.e., a chair, the design and assembly techniques are applicable to a wide variety of articles of furniture that can be created using the same principles as have been described herein with respect to the chair.

The invention can be used to design a bookcase, larger or smaller chairs, tables, benches, office partitions, ottoman and the like. In designing and constructing such other types of furniture, the side panels 40, 50, back panel 60 and primary support panel 10 can include the same array of tabs and notches as with the chair 100 illustrated in the drawing.

The RTA furniture concept of the present invention offers an easy and uniform construction technique over a wide range of furniture designs and types.

The design techniques and locking member provides a solid and lasting assembly of RTA furniture panels the design locks all panels so that all panels are, in effect, inter-engaged with each other. This feature provides a rigid, reliable and long lasting construction.

The design techniques and the locking member of this invention yield solid furniture construction, but allows easy and quick disassembly of the furniture if desired. Furniture made in accordance with the present invention can be simply disassembled by dislodging the arm supports 20, 30 and locking key 70 from the notch 49, 59. This frees the components for easy disassembly.

While the invention has been illustrated and described in detail in the drawing and foregoing description, the same should be considered as illustrative and not limiting or restrictive. It is understood that only a preferred embodiment has been presented and that all changes, modifications and applications that come within the spirit of the invention are to be protected. It is further understood that the present invention includes any alterations and modifications to the illustrated embodiments and includes further applications of the principles of the invention as would normally occur to one skilled in the art to which this invention pertains.

What is claimed is:

1. An article of furniture comprising:

a first generally horizontal load supporting panel (10) having tabs (14, 16, 18) on three edges thereof with at least two of said tabs defining notches (15, 17) generally perpendicular to the at least two of the tabs (14, 16), a pair of vertical load supporting side panels (40, 50) each of said side panels (40, 50) including an L-shaped slot (49, 59) therein wherein (a) a first portion of each of said L-shaped slots (49, 50) having a generally horizontal orientation for accepting one of said tabs (14, 16) and cooperating with one of the notches (15, 17) therein for supporting the first panel (10) against vertical and forward horizontal movement and (b) a second portion of each of said slots (49, 59) having a generally vertical orientation, said side panels each having a first generally vertically extending tab (46, 56), and a second generally vertically extending tab (48, 58), a fourth panel (60) having a generally horizontal slot (66) for accepting and providing support for the third tab (18) on said first panel (10) and a pair of generally vertical slots therein (62, 64) for accepting the second and third panels (40, 50) and second vertically extending tabs (48, 58), and engaging the second vertically extending tabs (48, 58) on the second and third panels (40, 50), and the first panel (10), the fourth panel providing support for said first, second and third panels (10, 40, 50) and a C-shaped key (70) in each of the second portions of the L-shaped slots (49, 59) in said side panels (40, 50) for retaining the first, second, third, and fourth panels (10, 40, 50 and 60) against movement.

2. An article of furniture as described in claim 1 including:

a pair of mirror image panels (20, 30), each supported on one of said second and third panels (40, 50) and having a slot (26, 36) therein for receiving one of said first generally vertically extending tabs (46, 56) on said second and third panels (40, 50) and a rearwardly extending tab (28, 38) defining a notches (24, 34) for receiving one of said second generally vertically extending tabs (48, 58) on said second and third panels (40, 50), and the fourth panel (60) includes a pair of generally horizontal slots (63, 65) for receiving one of the rearwardly extending tabs (28, 38) on said mirror image panels (20, 30) which, with the generally vertically extending tabs (46, 56) on said second and third panels (40, 50), support and stabilize the mirror image panels (20, 30).

* * * * *